United States Patent [19]

Conway

[11] 4,233,922

[45] Nov. 18, 1980

[54] FLUID TRANSFER SYSTEM FOR TANKER VESSELS

[76] Inventor: Charles S. Conway, Featherbed La., New Vernon, N.J. 07976

[21] Appl. No.: 10,909

[22] Filed: Feb. 9, 1979

[51] Int. Cl.[3] ..... B63B 25/12

[52] U.S. Cl. ..... 114/74 R; 137/587; 141/290; 220/85 VS

[58] Field of Search ..... 114/74 R, 74 T, 74 A, 114/211, 212; 141/290; 220/85 VR, 85 VS; 62/50, 54; 137/572, 575, 587

[56] References Cited

U.S. PATENT DOCUMENTS

| | | | |
|---|---|---|---|
| 2,703,138 | 3/1955 | Amon, Jr. | 137/575 X |
| 2,928,436 | 3/1960 | Wendrow et al. | 141/290 X |
| 3,453,836 | 7/1969 | Kerr | 62/54 X |
| 3,844,239 | 10/1974 | McLaughlin | 114/74 R |
| 3,926,135 | 12/1975 | De Gregorio | 114/74 R |

FOREIGN PATENT DOCUMENTS

| | | | |
|---|---|---|---|
| 1378492 | 12/1974 | United Kingdom | 114/74 R |

OTHER PUBLICATIONS

AIR-LIST-ADS, "Refrigerated Gasoline Helps Reduce Waste," Aug. 1977.

*Primary Examiner*—Sherman D. Basinger
*Attorney, Agent, or Firm*—Kenyon & Kenyon

[57] ABSTRACT

An improved fluid transfer system for a tanker vessel adapted for the transportation of fluid chemical and petroleum products in water. The vessel includes a hull comprising a bottom and sides, a top deck, a plurality of watertight cargo compartments disposed within the hull between the top deck and the hull bottom for receiving the fluid products, cargo expansion trunks coupled to and opening downwardly into each of the cargo compartments, branch vent lines coupled to the cargo expansion trunks and including pressure/vacuum relief valves, and a longitudinally disposed trunk vent line including a pressure/vacuum relief valve coupled to the branch vent lines and communicative with the atmosphere for venting contaminated gases formed by the fluid products and contained within the cargo compartments of the vessel from the cargo compartments through the cargo expansion trunks and the branch vent lines to the atmosphere. The improvement of the invention comprises bypass vent lines including vent closure valves which are coupled at one end to the trunk vent line of the vessel and at the other end to the cargo expansion trunk of at least one cargo compartment of the vessel. The vent closure valves are adapted to be opened and couple the trunk vent line to the cargo expansion trunk of the cargo compartment through the bypass vent line and thereby bypass the pressure/-vacuum relief valve of the branch vent line to vent contaminated gases from the cargo compartment through the cargo expansion trunk and the bypass vent line to the trunk vent line of the vessel.

10 Claims, 2 Drawing Figures

FLUID TRANSFER SYSTEM FOR TANKER VESSELS

BACKGROUND OF THE INVENTION

1. Field of the Invention

This invention relates generally to an improved system for the containment and transfer of contaminated gases which are formed by fluid chemical and petroleum products disposed in a storage tank. More specifically, the invention relates to an improved fluid transfer system for tanker vessels such as oil tankers for reducing air pollution which contains and controls the distribution of contaminated air, particularly air contaminated by hydrocarbon gases, disposed in land storage tanks during refilling of such storage tanks with fluid chemical and petroleum products carried by the tanker vessel so that the contaminated air is prevented from escaping to the atmosphere.

2. Description of the Prior Art

The transfer of petroleum and chemical products to and from tanker vessels is generally accomplished at present simply by movement of the fluid chemical and petroleum products from the cargo tanks of the tanker vessel to land storage tanks. No attempt is made to capture or contain contaminated air located within the land storage tanks being filled or, if the tanker vessel is being loaded, the cargo compartments of the tanker vessel. In contrast, the contaminated air is simply vented to the atmosphere during filling of such tanks.

Hydrocarbon vapor formed by petroleum products is, at present, discharged into the atmosphere in large quantities. Such discharges are particularly common at refineries as refinery tanks are filled by tankers and as tankers ballast their cargo tanks after the completion of the discharge of their cargo and during cargo transfer operations on the tankers. At present, approximately 7.5 million barrels (315 million gallons) of fuel for transportation systems are consumed in the United States each day. The handling of this volume of fuel results in the discharge of approximately 168 million cubic feet of hydrocarbon gas to the atmosphere each day in the United States, a significant portion of which results from the transfer of fluid petroleum products between tanker vessels and refinery land storage tanks. These hydrocarbon gases, as well as the gases produced by fluid chemical products, are a major cause of air pollution. Moreover, the presence of such vapors presents a safety hazard in work areas and public places.

SUMMARY OF THE INVENTION

It is therefore an object of the present invention to provide an improved fluid transfer system for tanker vessels for the containment and transfer of contaminated gases formed by fluid chemical and petroleum products carried in the cargo tanks of such tanker vessels.

It is also an object of the present invention to provide an improved fluid transfer system for tanker vessels for containing and transferring contaminated gases formed by fluid chemical and petroleum products between the tanker vessel and land storage tanks which permits the containment and transportation of such gases to a location remote from the place where the transfer of the fluid chemical and petroleum products takes place, such as far out at sea, where the contaminated gases may be vented to the atmosphere without contributing to atmospheric pollution of populated land areas.

These and other objects of the invention are achieved in a tanker vessel for the transportation of fluid chemical and petroleum products in water, which vessel includes a hull comprising a bottom and sides, a top deck, a plurality of water-tight and substantially air-tight cargo compartments disposed within the hull between the top deck and the hull bottom for receiving the fluid chemical and petroleum products, cargo expansion trunk means coupled to and opening downwardly into each of the cargo compartments, branch vent line means coupled to to cargo expansion trunk means and including pressure/vacuum relief valve means, and a longitudinally disposed trunk vent line means including pressure/vacuum relief valve means, the trunk vent line means being coupled to the branch vent line means and being communicative with the atmosphere for venting contaminated gases formed by the fluid products and contained within the cargo compartments from the cargo compartments through the cargo expansion trunk means and the branch vent line means to the atmosphere. The improvement comprises bypass vent line means including vent closure valve means coupled to at least one of the cargo compartments, the bypass vent line means being coupled at one end to the trunk vent line means and at the other end to the cargo expansion trunk means of the one cargo compartment. The vent closure valve means is adapted to be opened and couple the trunk vent line means to the cargo expansion trunk means of the one cargo compartment through the bypass vent line means thereby bypassing the pressure/-vacuum relief valve means of the branch vent line means and venting contaminated gases from the one cargo compartment through the cargo expansion trunk means of the one cargo compartment and the bypass vent line means to the trunk vent line means.

These and other novel features and advantages of the fluid transfer system of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
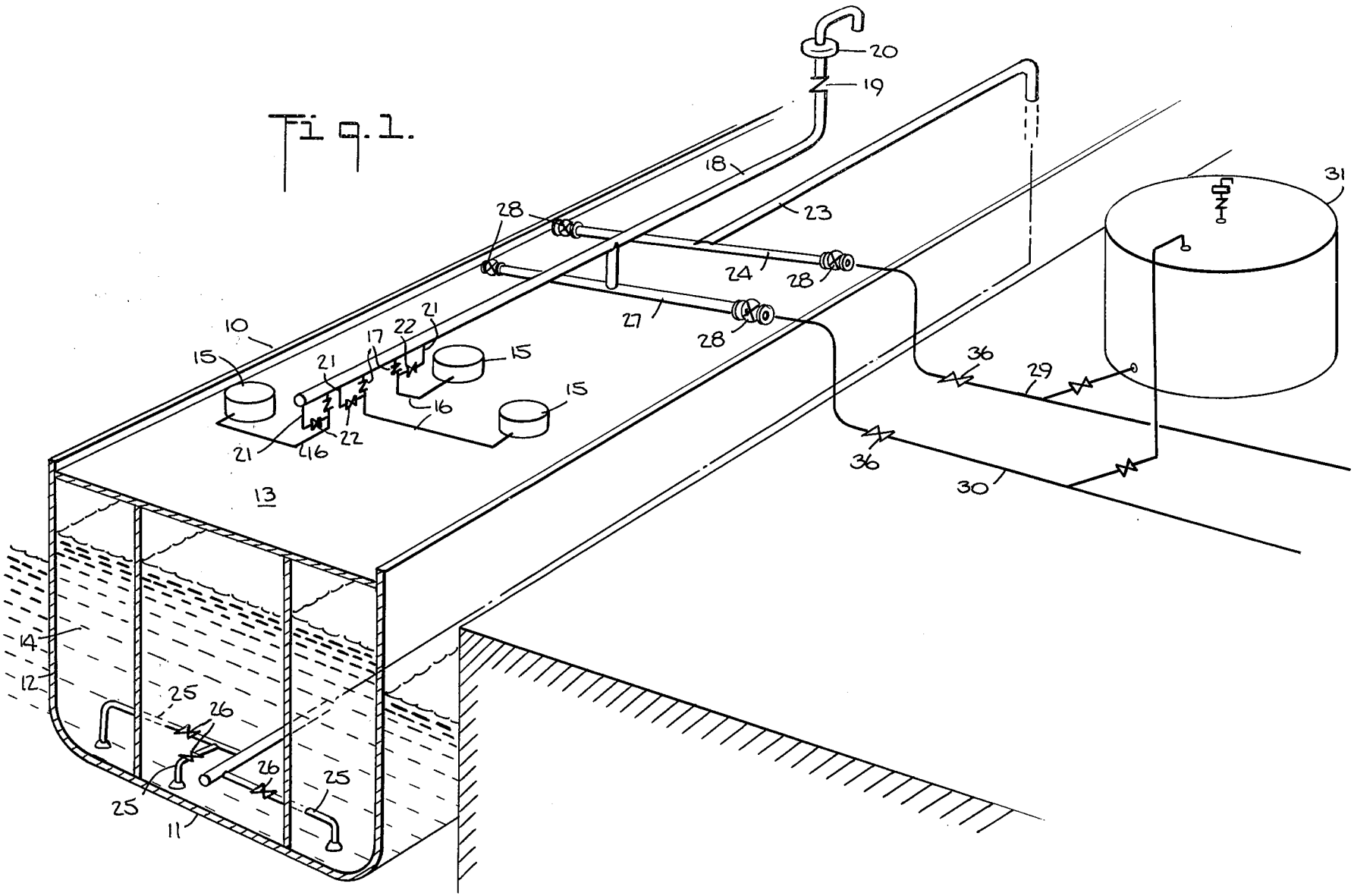
FIG. 1 is a partial perspective view of an improved fluid transfer system for tanker vessels constructed according to the present invention.

Referring now to the drawings, there is shown a tanker vessel 10 which is adapted for the transportation of fluid chemical and petroleum products in water. The vessel includes a hull comprising a bottom 11 and sides 12, a top deck 13, and a plurality of water-tight and substantially air-tight cargo compartments 14 disposed within the hull between the top deck and the hull bottom for receiving fluid chemical and petroleum products. A plurality of cargo expansion trunks 15 are coupled to and open downwardly into each of the cargo compartments 14 of the vessel. A plurality of branch vent lines 16 are coupled to the cargo expansion trunks and include pressure/vacuum relief valves 17, specifically closed type pressure/vacuum relief valves, which are serially coupled to the branch vent lines intermediate the ends thereof. A longitudinally disposed trunk vent line 18 including a pressure/vacuum relief valve 19 and a flame screen 20 serially coupled to the trunk line 18 at one end is connected to the branch vent lines 16 and is communicative with the atmosphere for venting contaminated gases formed by the fluid products within the cargo compartments 14 of the vessel to the atmosphere. Valve 19 preferably has two separate pressure/-vacuum level settings determined by the vessel design, a first one which is the same as that of valves 17 for operation during the venting of gases through branch vent lines 16 and a second one greater than the first for operation during the venting of the gases through a plurality of bypass vent lines, described subsequently herein.

Figure 2:
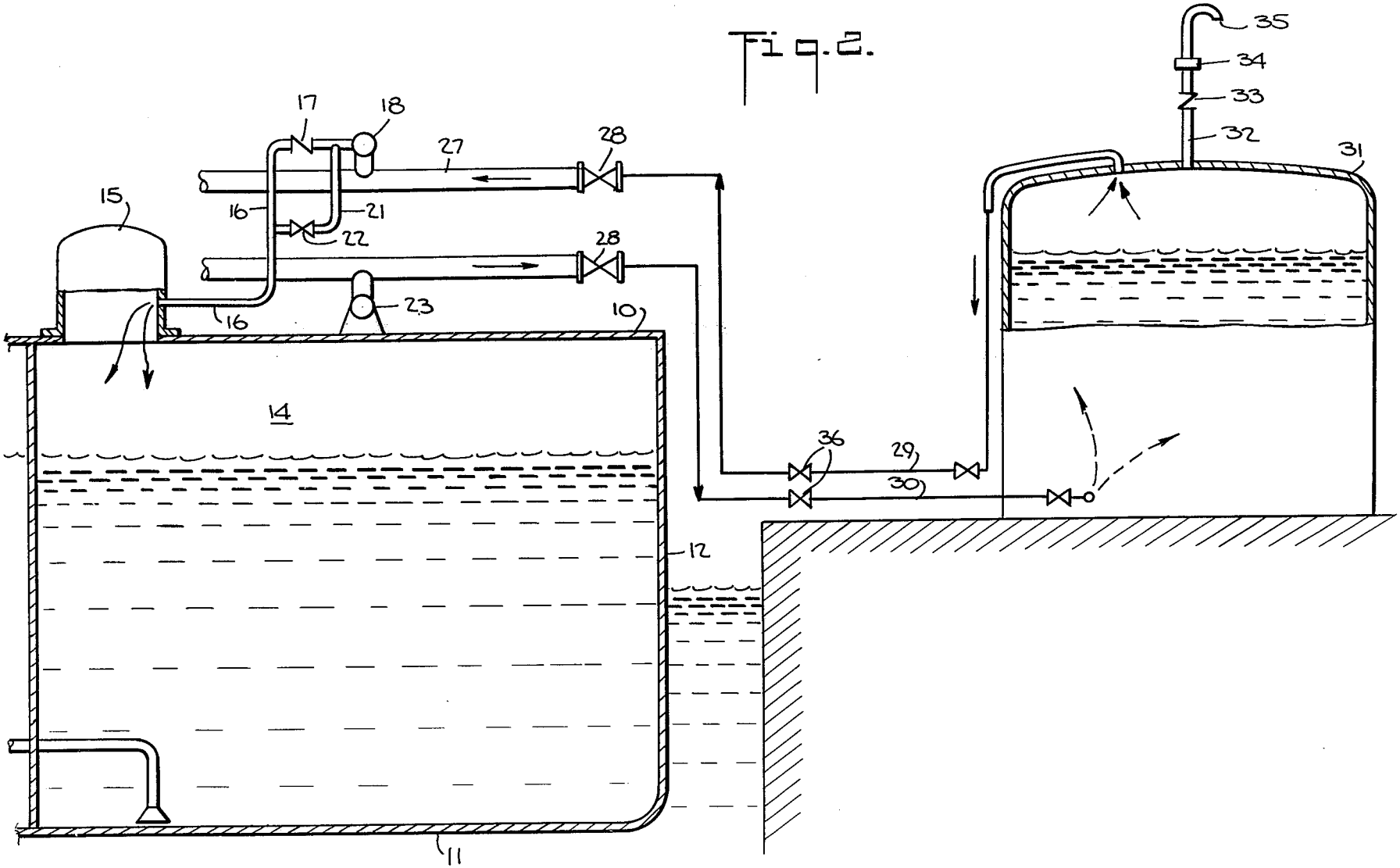
FIG. 2 is a partial, cross-sectional view of the fluid transfer system illustrated in FIG. 1.

As shown particularly in FIG. 2, the tanker vessel includes a plurality of bypass vent lines 21 which include bypass vent closure valves 22, preferably either automatic or manually operable closure valves such as a gate valve, globe valve, or butterfly valve, serially coupled to the bypass vent lines intermediate the ends thereof. The vent lines 21 are coupled at one end to the trunk vent line 18, specifically to the branch vent lines at a point between the pressure/vacuum relief valves 17 of the branch vent lines 16 and the trunk vent line 18, and at the other end to the cargo expansion trunks 15, specifically to the branch vent lines 16 at a point between the pressure/vacuum relief valves 17 of the branch vent lines 16 and the cargo expansion trunks 15. The vent closure valves 22 are adapted to be opened and to couple the trunk vent line 18 to cargo expansion trunks 15 through the bypass vent lines 21.

The tanker vessel 10 also includes a longitudinally disposed main cargo trunk line 23 coupled to the cargo compartments 14 for charging and discharging fluid products. A transverse main cargo trunk line 24 is disposed perpendicular to and is coupled to the longitudinally disposed main cargo trunk line 23. A plurality of branch cargo lines 25 are coupled to the cargo compartments 14 of the vessel and include closure valves 26 for controlling the transfer of fluid chemical and petroleum products to and from the cargo compartments of the vessel. The branch cargo lines 25 are coupled to the longitudinally disposed main cargo line 23.

The tanker vessel 10 also includes a transverse trunk vent line 27 which is disposed perpendicular to and is coupled to the longitudinally disposed trunk vent line 18. Control valves 28, specifically either automatic or manually operable closure valves such as a gate valve, globe valve or a butterfly valve, are coupled to the transverse trunk vent line 27 and the transverse main cargo trunk line 24 for controlling the transfer of fluid products and gases to and from the cargo compartments 14. Control valves 28 are coupled to fluid conduits 29 and 30, one of which is used for the passage of liquid cargo and the other for the passage of contaminated gases, and thereby to a land storage tank, specifically an above-ground shore storage tank 31 of a tank farm or a refinery, located on one side of vessel 10 for transferring fluid chemical and petroleum products and contaminated gases between the tank 31 and the cargo compartments 14 of vessel 10. It should be noted that tank 31 may also comprise a below-ground shore storage tank, and that one or more shore storage tanks, barges or tank ships may be disposed on the other side of vessel 10, and in such an arrangement additional fluid conduits would be coupled to valves 28 on the other side of vessel 10.

Land storage tank 31 includes a vent pipe 32 having a serially coupled pressure/vacuum relief valve 33 and a flame arrester 34 disposed between the storage tank and the open end 35 of the vent pipe. Suitable valve couplings 36 are coupled to the fluid conduits 29 and 30 for permitting the coupling and decoupling of the conduits to the tanker vessel for charging and discharging cargo. These valve couplings may include flanged pipe joints or any other suitable coupling mechanism. It should be noted that although only one shore storage tank has been shown, a plurality of such tanks may be coupled by individual fluid conduits and a main vent trunk conduit and a main cargo transfer conduit to the transverse trunk vent line and the transverse main cargo trunk line of the tanker vessel.

In normal operation, contaminated gases contained in cargo compartments 14 of the vessel 10 and land storage tank 31 would be vented to the atmosphere through cargo expansion trunks 15, branch vent lines 16, pressure/vacuum relief valves 17, trunk vent line 18, and pressure/vacuum relief valve 19, and through vent pipe 32 and pressure/vaccum relief valve 33 to the atmosphere, respectively, during filling of either the cargo compartments of the vessel or the land storage tank. During filling of the compartments or the tank with a fluid chemical or petroleum product, the pressure/vaccum relief valves of the tanker vessel and the land storage tank open as the pressure inside the cargo compartments or tank increases and thereby release the pressure and the contaminated gases to the atmosphere. In a tanker vessel equipped with the fluid transfer system of the invention, however, closure valves 22 of bypass vent lines are opened after valve 19 has been set to its second pressure/vaccum level to permit the gases to bypass pressure/vaccum relief valves 17 in branch vent lines 16 and interconnect trunk vent line 18 with cargo expansion trunks 15 and the cargo compartments of the vessel through bypass vent lines 21 so as to form an open vent system. The second pressure/vacuum level of valve 19 is set so that a greater pressure can exist in and thus a greater volume of gases can be vented to the cargo compartments 14 than would be possible during normal operation so as to enable the containment of a larger volume of gases. During unloading of the fluid products in the cargo compartments of vessel 10, the control valves 28 are opened, and as the fluid products are pumped through branch cargo lines 25, longitudinal main cargo trunk line 23 and transverse main trunk line 24 through fluid conduit 29 to storage tank 31, the filling of tank 31 with the fluid product simultaneously expels contaminated gases contained in the tank and vents them through fluid conduit 30 through transverse trunk vent line 27, trunk vent line 18, bypass vent lines 21 and cargo expansion trunks 15 into the cargo compartments 14 of the vessel as it is emptied, thereby by containing and controlling the distribution of the contaminated gases. If the tanker vessel is being loaded, the operation of the system would be the reverse, with the contaminated gases contained in the tanker being returned to the land storage tank as it is emptied. Another alternative method of operation during loading would be to open only control valve 28 coupled to transverse main cargo trunk line 24 and to selectively open closure valves 22 between a cargo compartment being filled with the fluid product from the land storage tank and one or more empty cargo compartments in vessel 10 so as to vent contaminated gases from the compartment being filled to the empty compartment or compartments. The same method of operation would be used where the tanker vessel compartments are filled with sea water during ballasting. In this case, however, both of the control valves 28 coupled to lines 24 and 27 would be closed and water would be pumped into cargo compartments chosen for ballasting. The contaminated gases contained in those compartments being filled with ballast would be simultaneously vented to other empty compartments in the tanker vessel through the selectively opened closure valves 22. It should be noted that during ballasting, control valve 28 coupled to transverse trunk vent line 27 could also be opened to permit contaminated gases to be vented to an empty land storage tank 31.

After the foregoing transfer of contaminated gases and fluid chemical and petroleum products is completed, closing of the closure valves 22 of the vessel 10 and control valves 28 and 36 coupled to the land storage tank 31 contains the contaminated gases in either the cargo compartments 14 of the vessel or the land storage tank 31 of the refinery. In either case, the contaminated gases may be removed from the cargo compartments or land storage tank and reduced to a petroleum product in the refinery by, for example, compression or refrigeration. Alternatively, contaminated gases in tank 31 may be vented to the cargo compartments of the tanker vessel 10 and contained therein until the vessel is far out at sea, whereupon the gases can be vented to the atmosphere without contributing to atmospheric pollution of populated land areas.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a tanker vessel for the transportation of fluid chemical and petroleum products in water, said vessel including a hull comprising a bottom and sides, a top deck, a plurality of water-tight and substantially air-tight cargo compartments disposed within said hull between said top deck and said hull bottom for receiving said products, cargo expansion trunk means coupled to and opening downwardly into each of said cargo compartments, branch vent line means coupled to the cargo expansion trunk means and including pressure/-vacuum relief valve means, and longitudinally disposed trunk vent line means including pressure/vacuum relief valve means, said trunk vent line means being coupled to said branch vent line means and being communicative with the atmosphere for venting contaminated gases formed by said fluid products and contained within said cargo compartments from said cargo compartments through said cargo expansion trunk means and said branch vent line means to the atmosphere, the improvement comprising bypass vent line means including vent closure valve means coupled to at least one of said cargo compartments, said bypass vent line means being coupled at one end to said trunk vent line means and at the other end to said cargo expansion trunk means of said one of said cargo compartments, said vent closure valve means being adapted to be opened and couple said trunk vent line means to said cargo expansion trunk means of said one of said cargo compartments through said bypass vent line means thereby bypassing said pressure/vacuum relief valve means of said branch vent line means and venting contaminated gases to or from said one of said cargo compartments through said cargo expansion trunk means of said one of said cargo compartments, and bypass vent line means and said trunk vent line means.

2. The improvement recited in claim 1, wherein said bypass vent line means is coupled at said one end to said branch vent line means at a point between said pressure/vacuum relief valve means of said branch vent line means and said trunk vent line means and at said other end to said branch vent line means at a point between said pressure/vacuum relief valve means of said branch vent line means and said cargo expansion trunk means of said one of said cargo compartments.

3. The improvement recited in claim 2, wherein said vent closure valve means comprises a closure valve serially coupled to said bypass vent line means intermediate the ends thereof.

4. The improvement recited in claim 3, wherein said pressure/vacuum relief means of said branch vent line means comprises a closed type pressure/vacuum relief valve serially coupled to said branch vent line means intermediate the ends thereof and the ends of said bypass vent line means.

5. The improvement recited in claim 1, wherein said tanker vessel includes a plurality of said branch vent line means and said bypass vent line means coupled to a plurality of said cargo expansion trunk means, said vent closure valve means of said bypass vent line means being adapted to be opened simultaneously for interconnecting a plurality of said cargo compartments of said tanker vessel through said cargo expansion trunk means, said bypass vent line means, and said trunk vent line means and thereby contaminated gases contained in one or more of said cargo compartments from said compartments to one or more other, empty cargo compartments of said tanker vessel.

6. The improvement recited in claim 1, wherein said tanker vessel includes longitudinally disposed main cargo trunk line means coupled to said cargo compartments for charging and discharging said fluid products, and wherein said trunk vent line means further comprises transverse trunk vent line means disposed perpendicular to and coupled to said longitudinally disposed trunk vent line means, and control valve means, coupled to said main cargo trunk line means and said transverse trunk vent line means, for controlling the transfer of said fluid products to and from said cargo compartments of said tanker vessel through said main cargo trunk line and the transfer of said contaminated gases to and from said cargo compartments of said tanker vessel through said transverse trunk vent line means, said longitudinally disposed trunk vent line means, said bypass vent line means, and said cargo expansion trunk means, said control valve means being adapted for coupling to a closed, substantially air-tight land storage tank containing contaminated gases adapted to receive fluid chemical and petroleum products from said cargo compartments of said tanker vessel.

7. The improvement recited in claim 6, wherein said control valve means comprises closure valves serially coupled to said transverse trunk vent line means and said main cargo trunk line means.

8. The improvement recited in claim 6, further comprising first and second fluid conduit means coupled to said land storage tank, said transverse trunk vent line means and said main cargo trunk line means for transferring fluid chemical and petroleum products and contaminated gases between said land storage tank and said cargo compartments of said tanker vessel, said control valve means being serially coupled between said first and second fluid conduit means and said transverse trunk vent line means and said main cargo trunk line means for containing contaminated gases in said land storage tank and said cargo compartments of said tanker vessel.

9. The improvement recited in claim 8, wherein said land storage tank comprises an above-ground, shore storage tank.

10. The improvement recited in claim 6, wherein said main cargo trunk line means further comprises transverse main cargo trunk line means disposed perpendicular to and coupled to said longitudinally disposed main cargo trunk line means, and branch cargo line means coupled to said cargo compartments of said tanker vessel including closure valve means for controlling the transfer of fluid chemical and petroleum products to and from said cargo compartments of said tanker vessel, said branch cargo line means being coupled to said longitudinally disposed main cargo line means and said transverse main cargo line means being serially coupled to said control valve means.

* * * * *

UNITED STATES PATENT AND TRADEMARK OFFICE

CERTIFICATE OF CORRECTION

PATENT NO. : 4,233,922

DATED : November 18, 1980

INVENTOR(S) : Charles S. Conway

It is certified that error appears in the above—identified patent and that said Letters Patent is hereby corrected as shown below:

Column 2, line 13, change "to" (second occurrence) to -- the --.

Column 4, line 31, after "vent lines" insert -- 21 --.

Column 4, line 53, after "thereby" delete "by".

Column 6, line 20, after "relief" insert -- valve --.

Column 6, line 34, after "thereby" insert -- venting --.

Signed and Sealed this

*Thirty-first* Day of *March 1981*

[SEAL]

*Attest:*

RENE D. TEGTMEYER

*Attesting Officer*

*Acting Commissioner of Patents and Trademarks*